United States Patent [19]

Hill, Jr.

[11] Patent Number: 4,518,133

[45] Date of Patent: May 21, 1985

[54] YARN PACKAGE

[75] Inventor: Broadus E. Hill, Jr., Wilmington, N.C.

[73] Assignee: E. I. Du Pont de Nemours and company, Wilmington, Del.

[21] Appl. No.: 642,434

[22] Filed: Aug. 20, 1984

[51] Int. Cl.[3] ..... B65H 55/00

[52] U.S. Cl. ..... 242/165; 242/18 PW; 242/125.1

[58] Field of Search ..... 242/165, 166, 159, 18 PW, 242/18 EW, 125, 125.1, 125.2, 125.3, 164

[56] References Cited

U.S. PATENT DOCUMENTS

| | | | |
|---|---|---|---|
| 2,585,584 | 2/1952 | Pollock, Jr. | 242/165 X |
| 3,283,489 | 11/1966 | Bakker | 242/165 X |
| 3,326,494 | 6/1967 | Hartley, Jr. | 242/125.1 |
| 3,356,312 | 12/1967 | Briggs et al. | 242/164 |
| 3,356,313 | 12/1967 | Johnson et al. | 242/165 |
| 3,640,058 | 2/1972 | Hartley, Jr. | 242/18 PW X |
| 3,677,492 | 7/1972 | Ueda et al. | 242/164 |
| 4,005,567 | 2/1977 | Mariani | 242/125.2 X |

*Primary Examiner*—Stanley N. Gilreath

[57] ABSTRACT

A yarn package structure that includes a package support having a main body of yarn, a yarn transfer tail consisting of a plurality of helical turns leading to said main body of yarn, a plurality of circumferential turns of yarn located in a circumferential stringup groove adjacent one end of the package support leading to said transfer tail, and a surface cavity on the package support intersecting the plane of said stringup groove. A means for pulling the circumferential turns of yarn over the end of the package support is secured by the circumferential turns of yarn against the package support.

2 Claims, 3 Drawing Figures

YARN PACKAGE

BACKGROUND OF THE INVENTION

This invention relates to winding and unwinding yarn packages and, more particularly it relates to a yarn package with a readily accessible transfer tail.

It is known in the art that a transfer tail can be included in the initial length of yarn wound on a support and be positively secured during the winding of the remainder of the yarn package, yet readily available for tying directly to the outer end of yarn on another package. The purpose in providing a transfer tail on the yarn package is to enable an uninterrupted flow of yarn from a creel or other holder on which the packages are supported in adjacent positions. Continuity of yarn flow into textile processes may thus be sustained.

Hartley in U.S. Pat. No. 3,326,494 discloses a support on which a yarn package can be wound with a transfer tail which is secure yet readily accessible and this is achieved by providing an elongated yarn package support of the type on which a starting end of yarn is secured before initiation of a helical transfer tail with at least one surface cavity which facilitates access to the transfer tail. This cavity is spaced from the end of the support, leaving a smooth continuous edge. As suggested by Hartley, when one wishes to loosen the transfer tail, the package is held in a convenient position and the end of the scissors or other edged tool is inserted in the surface cavity and the transfer tail is severed and then may be unwrapped for tying to the outer end of a second full package. However, this approach is not entirely satisfactory because of the time required and the possibility of damage to the transfer tail or the package side wall while freeing the transfer tail.

SUMMARY OF THE INVENTION

The above-noted deficiencies are overcome by means of a yarn package structure that includes a package support having a main body of yarn, a yarn transfer tail consisting of a plurality of helical turns leading to said main body of yarn, a plurality of circumferential turns of yarn located in a circumferential stringup groove adjacent one end of the package support leading to said transfer tail, and a surface cavity on the package support intersecting the plane of said stringup groove. A means for pulling the circumferential turns of yarn over the end of the package support is secured by the circumferential turns of yarn against the package support.

DETAILED DESCRIPTION OF THE PREFERRED EMBODIMENT

Figure 1:
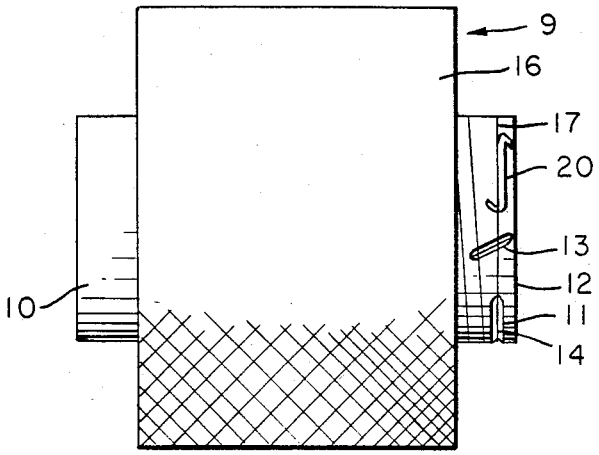
FIG. 1 is an elevational view of the yarn package of this invention.
Figure 2:
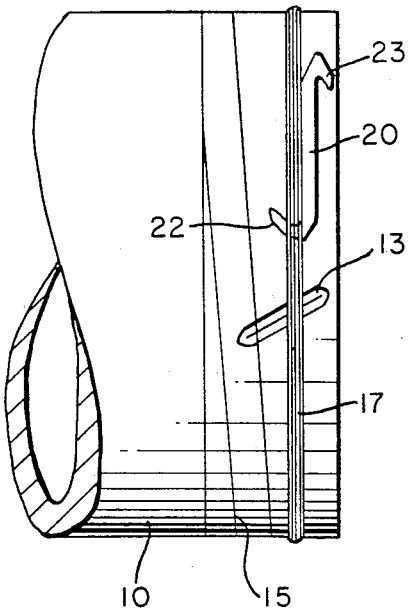
FIGS. 2 and 3 are enlarged partial elevation and side views of the package of FIG. 1.
Figure 3:
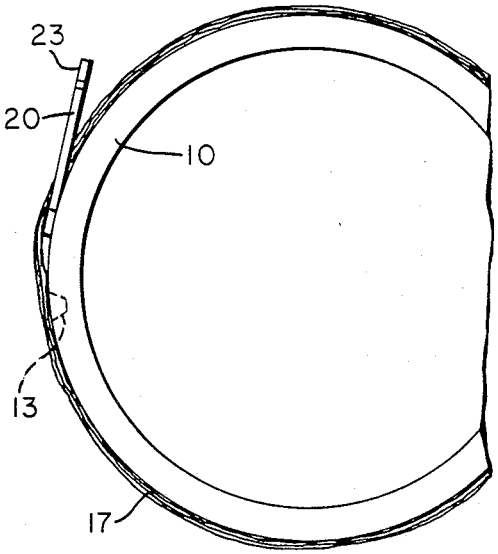

As shown in FIG. 1, the preferred yarn package 9 includes a support core 10 which is a hollow cylindrical tube having a partial circumferential groove 11 cut into its outer surface near and in parallelism with one end 12 and a cavity 13 intersected by the plane of groove 11. The cross section of groove 11 is substantially a narrow V-shaped configuration which permits the starting end 14 to be introduced into the groove, snagged and held as the spindle or chuck (not shown) which supports core 10 is rotated at the start of a package-winding operation. The yarn is wound in a plurality of circumferential turns 17 over cavity 13 and continues as a transfer tail 15, consisting of a plurality of helical turns, toward the central portion of core 10 where a package 16 is wound. Some portion of cavity 13 should be aligned with groove 11 to insure that starting end 14 will pass over the cavity. In order to provide a convenient length of yarn for tying to the outer end of another package, transfer tail 15 should be at least six inches long and the number of yarn turns may be made as required to provide the desired length.

The package of FIG. 1 may be wound on readily available winding equipment. For example, the bare core 10 may be placed on a chuck. After bringing the chuck to the required rotational speed, the running yarn may be introduced into groove 11 with a sucker gun or other similar stringup tool. After starting end 14 is snagged and broken, tail 15 is wound from turns 17 as a transfer mechanism guides the yarn laterally to a position where it is picked up by a suitable traverse guide through which it advances as the package 16 is wound.

A tab 20 has hooks 22, 23 formed on each end for ease of manipulation and installation on the yarn package 9. To install tab 20 a hook end, e.g., 22 is inserted in cavity 13 and under yarn turns 17. The tab is then pulled along the turns out of the cavity 13 onto the surface of support 10. In this manner turns of yarn 17 hold tab 20 in place and hook end 23 provides a finger grip.

The tab is then used to pull the unwanted portions of the turns 17 and the transfer tail 15 off the package support for a fast and high quality release of the transfer tail without the possibility of damage to the transfer tail or the side wall of the package.

Grooves or other means may be incorporated on the tab, particularly at the hook end to hold the tab in place as the package is handled.

While the preferred embodiment discloses tab 20 with a hook on each end, it is readily apparent that a tab with a hook on one end and another form of finger grip on the other end such as a flat-surfaced end would work as well.

I claim:

1. In a yarn package structure including a package support having a main body of yarn, a yarn transfer tail consisting of a plurality of helical turns leading to said main body of yarn, a plurality of circumferential turns of yarn located in a circumferential stringup groove adjacent one end of the package support leading to said transfer tail, and a surface cavity on the package support intersecting the plane of said stringup groove, a means for pulling the circumferential turns of yarn over the end of the package support, comprising: a tab having a hook formed on one end, said hook being positioned between said package support and said circumferential turns of yarn and being held in place thereby, the other end of said tab being positioned above said circumferential turns to provide a finger grip.

2. The yarn package structure of claim 1, said tab having a hook formed on both ends.

* * * * *